US006005201A

United States Patent [19]

Tanaka et al.

[11] Patent Number: 6,005,201

[45] Date of Patent: Dec. 21, 1999

[54] SWITCH

[75] Inventors: Yasuhide Tanaka; Keiichi Shimizu; Kiyotaka Yamaguchi, all of Kyoto, Japan

[73] Assignee: Omron Corporation, Kyoto, Japan

[21] Appl. No.: 08/970,399

[22] Filed: Nov. 14, 1997

[30] Foreign Application Priority Data

Nov. 15, 1996 [JP] Japan ..... 8-321127

[51] Int. Cl.[6] ..... H01H 15/06; H01H 5/04

[52] U.S. Cl. ..... 200/16 C; 200/433; 200/549; 200/551

[58] Field of Search ..... 200/5 R, 6 R–6 BB, 200/16 R, 16 C, 16 D, 339, 433–438, 526, 11 J, 11 K, 547–551, 564, 570, 571, 572, 303

[56] References Cited

U.S. PATENT DOCUMENTS

| | | | |
|---|---|---|---|
| 2,966,560 | 12/1960 | Gluck | 200/16 C |
| 4,095,070 | 6/1978 | Simpson | 200/525 |
| 4,147,908 | 4/1979 | Swann | 200/433 |
| 4,471,181 | 9/1984 | Dennison | 200/433 |
| 4,803,317 | 2/1989 | Sutoh et al. | 200/438 |
| 4,814,554 | 3/1989 | Magiera | 200/339 X |
| 5,051,552 | 9/1991 | Hou et al. | 200/16 C X |
| 5,293,507 | 3/1994 | Hayakawa | 200/553 X |
| 5,597,989 | 1/1997 | Nishio | 200/437 X |

*Primary Examiner*—J. R Scott
*Attorney, Agent, or Firm*—Morrison & Foerster LLP

[57] ABSTRACT

In a switch, the speed at which contacts are separated from each other is increased without depending on the speed at which an operating member is operated, so that an arc is prevented from being generated, to prevent the operating member to be deformed by heat generation and prevent the durability of the switch to be decreased due to the abrasion of the contacts. A movable contact member having movable contacts at both its ends is swingably supported with a common fixed contact projecting upward and serving as a fulcrum. A leaf spring is fixed to a slider. The leaf spring has a portion projecting in a U shape. The U-shaped portion is engaged with the center of the movable contact member. When the slider is moved, the U-shaped portion is distorted in the transverse direction. When the slider is further moved, the U-shaped portion gets beyond the fulcrum, so that the movable contact is rapidly separated from a normally open fixed contact.

14 Claims, 14 Drawing Sheets

SWITCH

BACKGROUND OF THE INVENTION

1. Field of the Invention

The present invention relates generally to a switch with contacts, and more particularly, to a switch applicable to a power window switch for vehicle use, for example.

1. Description of the Prior Art

As this type of switch, a slide switch, a seesaw switch, and a slide-type seesaw switch have been conventionally known. Representatives of the prior art switch will be described with reference to the drawings.

FIG. 17 is a cross-sectional view showing a switch main body of a slide switch, wherein a slider 111 operated from outside is movably supported on a terminal base 113 having fixed contacts, and a movable contact 116 is supported in the slider 111 and is pushed by a spring 117. When the slider 111 is slid, the movable contact 116 is moved. Consequently, a normally open fixed contact 115o and a common fixed contact 115m are switched.

FIG. 18 is a cross-sectional view showing a seesaw switch, wherein an operation knob 104 is rotatably supported on a switch case 103, and a pushing member 108 biased by a spring 107 is held in the operation knob 104. The pushing member 108 pushes a movable contact member 116 supported in seesaw fashion on a terminal base 113 which has fixed contacts 115. When the operation knob 104 is rotated, a point at which the pushing member 108 pushes the movable contact member 116 is displaced, and the movable contact member 116 is rotated in seesaw fashion. Consequently, the contacts are switched.

In these types of switches, however, the spring or the pushing member merely pushes the movable contact. Therefore, the speed at which the contacts are separated from each other is determined by the speed at which the slider (or the knob) is operated.

In a state where the fixed contact and the movable contact are brought into contact with each other, and a current flows therethrough, an arc is liable to generate when the movable contact is separated from the fixed contact. If the speed at which the movable contact is separated from the fixed contact is low, arc energy is increased.

A power window switch for vehicle use, for example, may, in some cases, be subjected to tampering for reducing the speed at which the slider or the knob is operated. Consequently, the speed at which contacts are separated from each other is reduced so that arc energy is extremely increased. Therefore, the slider composed of a resin molded part is deformed due to heat generated by switching the contacts, and the durability of the switch is decreased by the abrasion of the contacts. Further, a high-cost material having good heat resistance or a high-cost and large-sized contact material having good arc resistance must be used.

SUMMARY OF THE INVENTION

An object of the present invention is to provide a switch capable of separating a movable contact from a fixed contact quickly and as far as possible even if the speed at which a slider or a knob is operated is low.

A switch according to the present invention comprises a movable contact member having a movable contact in its part and swingably supported by a fulcrum, a resilient member brought into contact with the movable contact member at its pushing end and deformable in a first direction in which it pushes the movable contact member and in a second direction along the length of the movable contact member, and an operating member supporting the resilient member at its base end and moved by an external force, wherein the deformation of the resilient member in the second direction becomes large as the operating member is moved in a state where the movable contact of the movable contact member is brought into contact with a first fixed contact, and the movable contact member swings so that the movable contact is separated from the first fixed contact when the pushing end goes beyond the fulcrum by further movement of the operating member.

There are some modes, provided that the pushing end of the resilient member goes beyond the position of the fulcrum. One of the modes is such that the pushing end of the resilient member is engaged with the movable contact member, and the movable contact member is moved along its length as the operating member is moved. The other mode is such that the pushing end of the resilient member is movable along the movable contact member. In this case, the fulcrum is provided in the movable contact member. The fulcrum is formed of a second fixed contact, a common contact, whereby an arrangement for electrical connection to the movable contact is simplified.

The resilient member comprises a spring, or a spring and a pushing member. The operating member is slid or rotated.

According to the present invention, even if a knob or the other switch operation member for moving the operating member is slowly moved, the movable contact member quickly swings so that the movable contact is rapidly separated from the fixed contact to a far position when the pushing end of the resilient member gets beyond the fulcrum. The speed at which the contacts are separated from each other can be increased without depending on the speed at which the operating member is moved. Therefore, arc energy can be decreased, so that the durability of the switch can be improved. Particularly, the durability is significantly improved in a case where the switch is slowly operated. Further, the switch can be employed in a higher-temperature atmosphere. A low-cost material having low heat resistance can be used for the operating member. Further, a low-cost contact material having low arc resistance can be used.

In one embodiment of the present invention, an engaging portion is formed in the movable contact member, and the pushing end of the resilient member or the fulcrum is engaged with the engaging portion as the operating member is moved, while being disengaged therefrom by further movement of the operating member, so that the swing of the movable contact member is accelerated. An arc can be prevented from being generated.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

One embodiment in which the present invention is embodied in a power window switch for vehicle use will be described with reference to the drawings.

Figure 1:
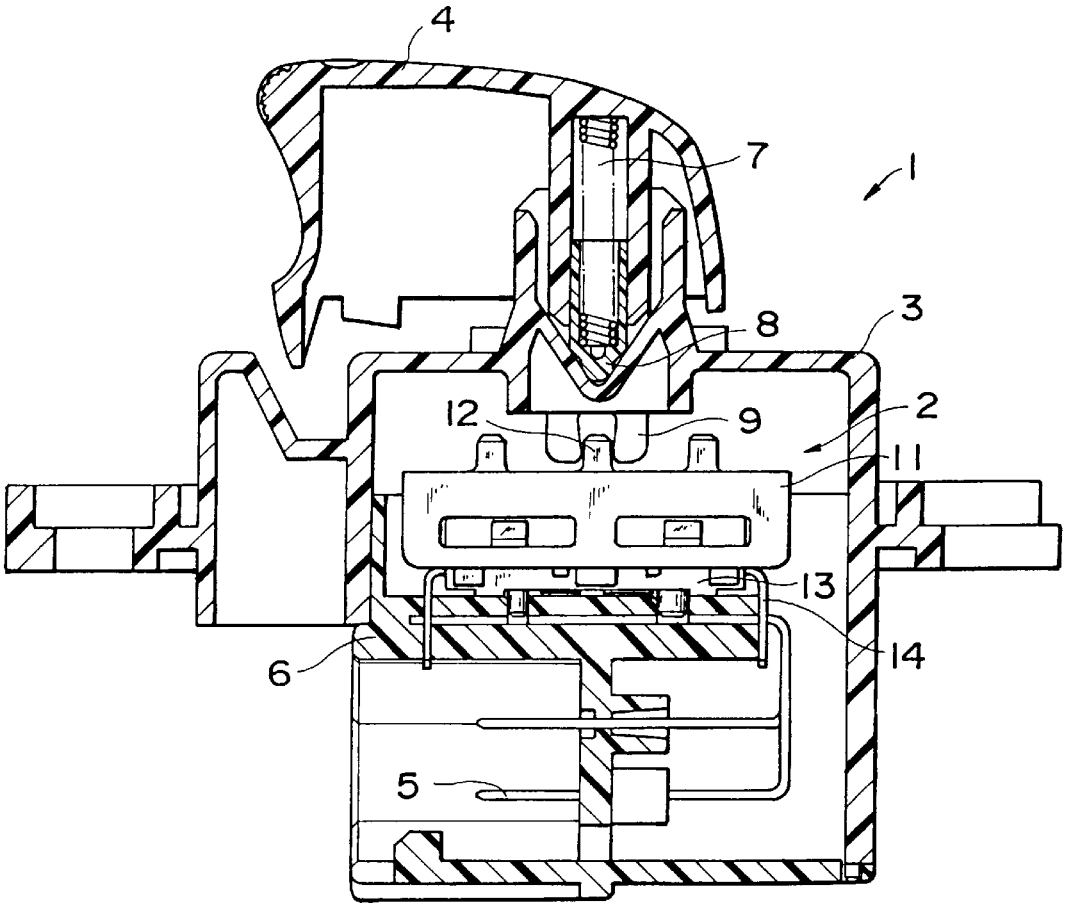
FIG. 1 is a cross-sectional view showing the whole of a switch for vehicle use according to one embodiment of the present invention.

FIG. 1 is a cross-sectional view showing the whole of a switch for vehicle use. The switch 1 comprises a switch casing 3 in which a switch unit 2 of a slide type seesaw system is accommodated, an operation knob 4 swingably supported on the switch case 31 and a connector block 6 provided with a connector 5. The operation knob 4 is provided with a pushing member 8 biased by a spring 7 for returning the knob to its rest position and fingers 9. The fingers 9 are engaged with a driving projection 12 of a slider 11 in the switch unit 2. The switch unit 2 has a terminal base 13 slidably supporting the slider 11 and provided with a contact mechanism. Reed terminals 14 pulled out of the terminal base 13 are connected to a circuit of the connector block 6.

Figure 2:
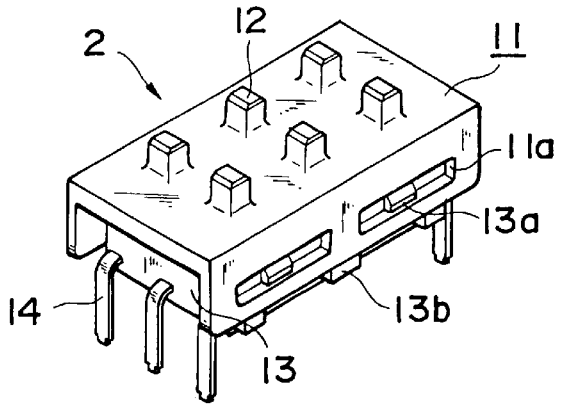
FIG. 2 is a perspective view showing a switch unit.
Figure 3:
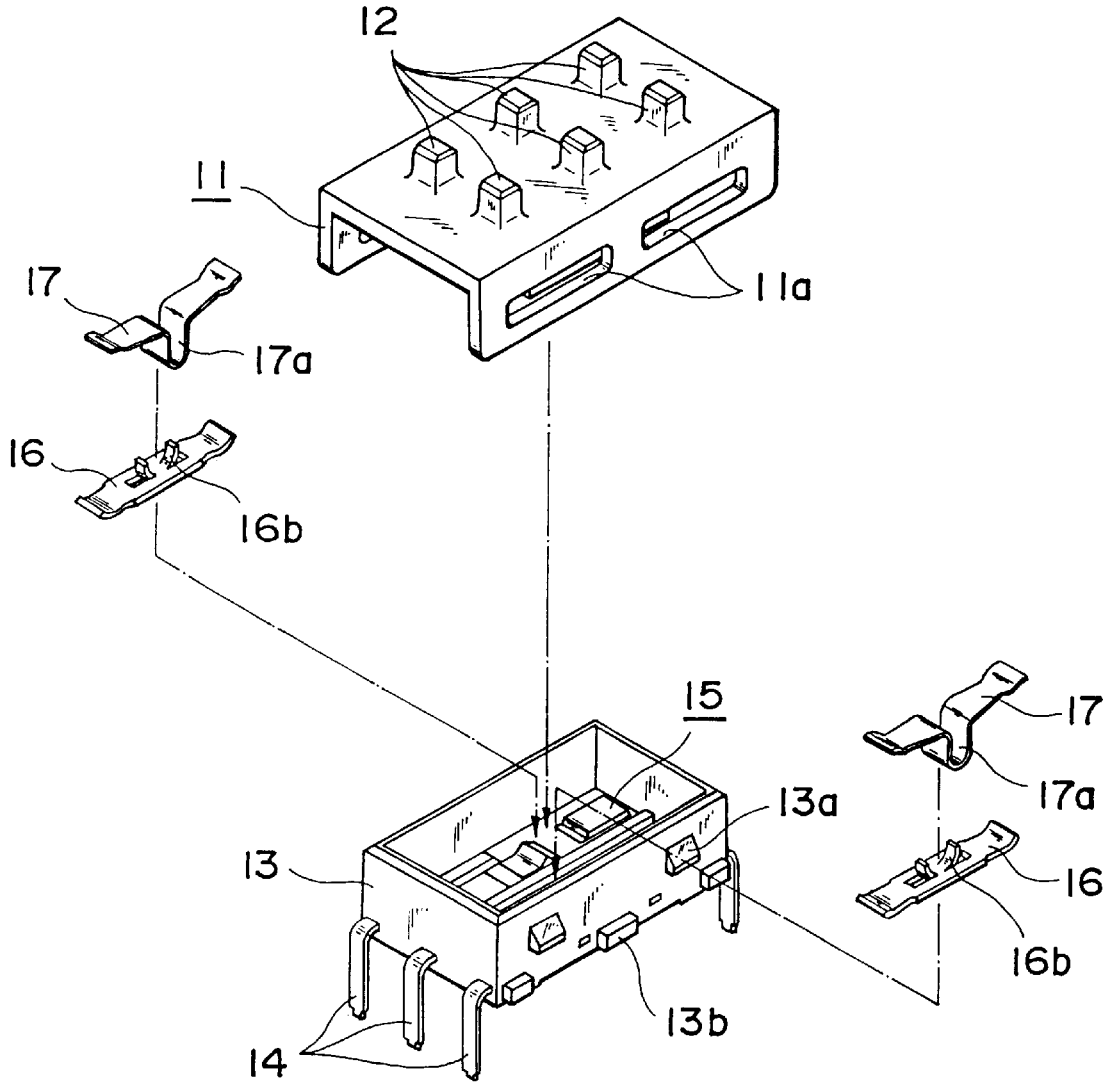
FIG. 3 is an exploded perspective view showing the switch unit.

FIG. 2 is a perspective view showing the switch unit 2, and FIG. 3 is an exploded perspective view showing the switch unit 2. The switch unit 2 is of a slide type seesaw system, and comprises the slider 11 operated from outside and the terminal base 13. The slider 11 is composed of a resin molded part. The terminal base 13 is provided with two rows of fixed contacts 15 each including a normally open contact 15*o*, a normally closed contact 15*c*, and a common contact 15*m* serving as a fulcrum. Further, a movable contact member 16 for switching on/off the circuit upon being brought into contact with and separated from the fixed contacts 15 and a spring 17 for biasing the movable contact member 16 under pressure as well as moving the biased movable contact member 16 are mounted in the terminal base 13. The spring 17 is a leaf spring or flat spring, and has a substantially U-shaped portion 17*a*. A projection 18 of the slider 11 is loosely inserted in the U-shaped portion 17*a* (see FIGS. 5, 9 and 10). Both ends of the movable contact member 16 are movable contacts 16*a*. U-shaped engaging members 16*b* are formed in the center of the movable contact member 16. The U-shaped portion 17*a* of the spring 17 is engaged with the U-shaped engaging members 16*b* upon being inserted therein, to push the movable contact member 16, and to apply a lateral force depending on the movement of the slider 11. Projecting claws 13*a* and stoppers 13*b* are formed on a side surface of the terminal base 13. The claws 13*a* are fitted in long holes 11*a* of the slider 11, to slidably support the slider 11.

Figure 5:
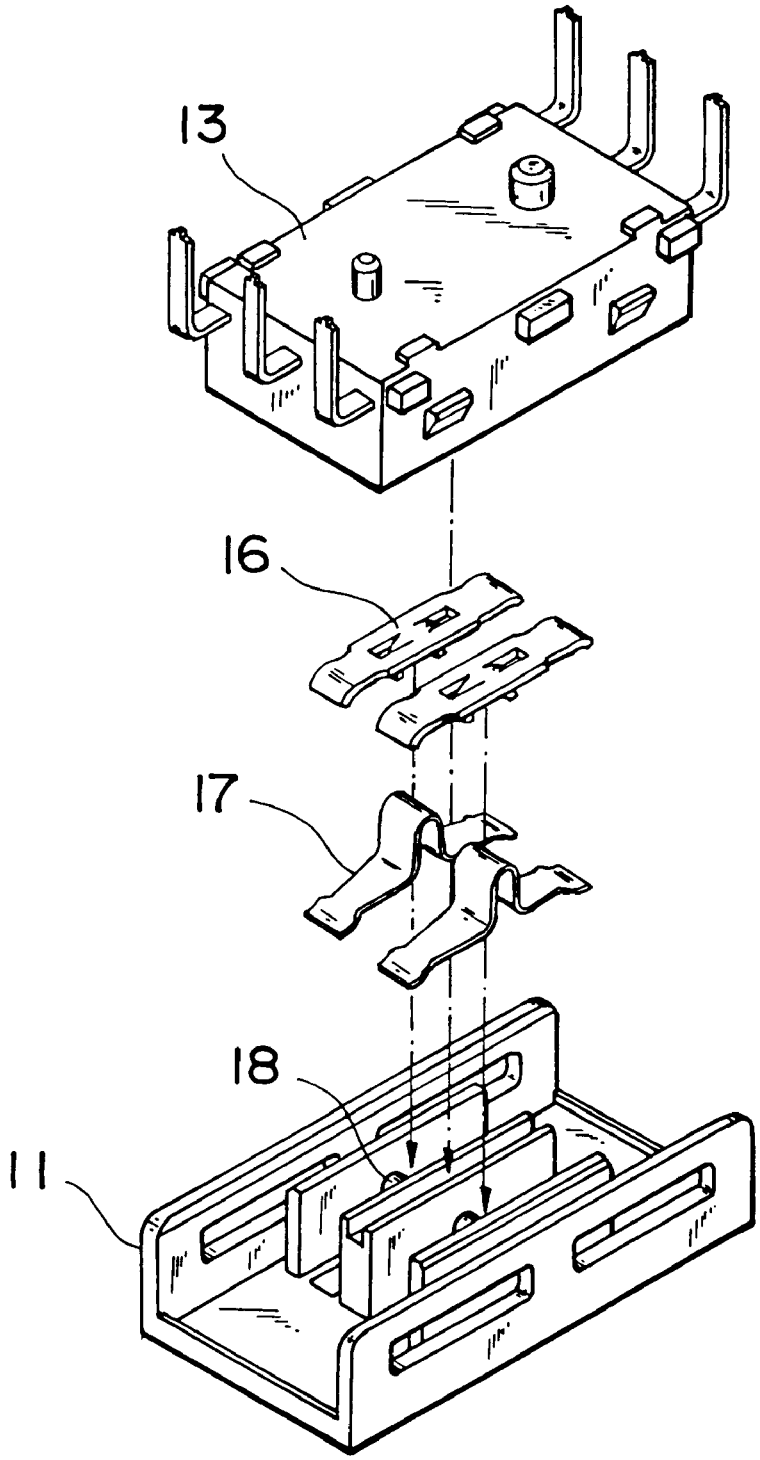
FIG. 5 is a diagram showing how the switch unit is assembled.

FIG. 5 shows how the switch unit 2 is assembled. At the time of assembling the switch unit 2, the slider 11 is turned upside down, and the spring 17 is mounted in the slider 11. The projection 18 is formed on an upper surface on the inside of the slider 11. The substantially U-shaped portion 17*a* of the spring 17 is fitted on the projection 18, and both ends of the spring 17 are engaged with steps formed on the inner and upper surface of the slider 11, to fix the spring 17. Further, the movable contact member 16 is put on the U-shaped portion 17*a*. The terminal base 13 turned upside down is further fitted into the slider 11. Since the switch unit 2 can be assembled in stacking fashion, the number of assembling processes can be reduced, and the assembly can be easily automated.

Figure 4:
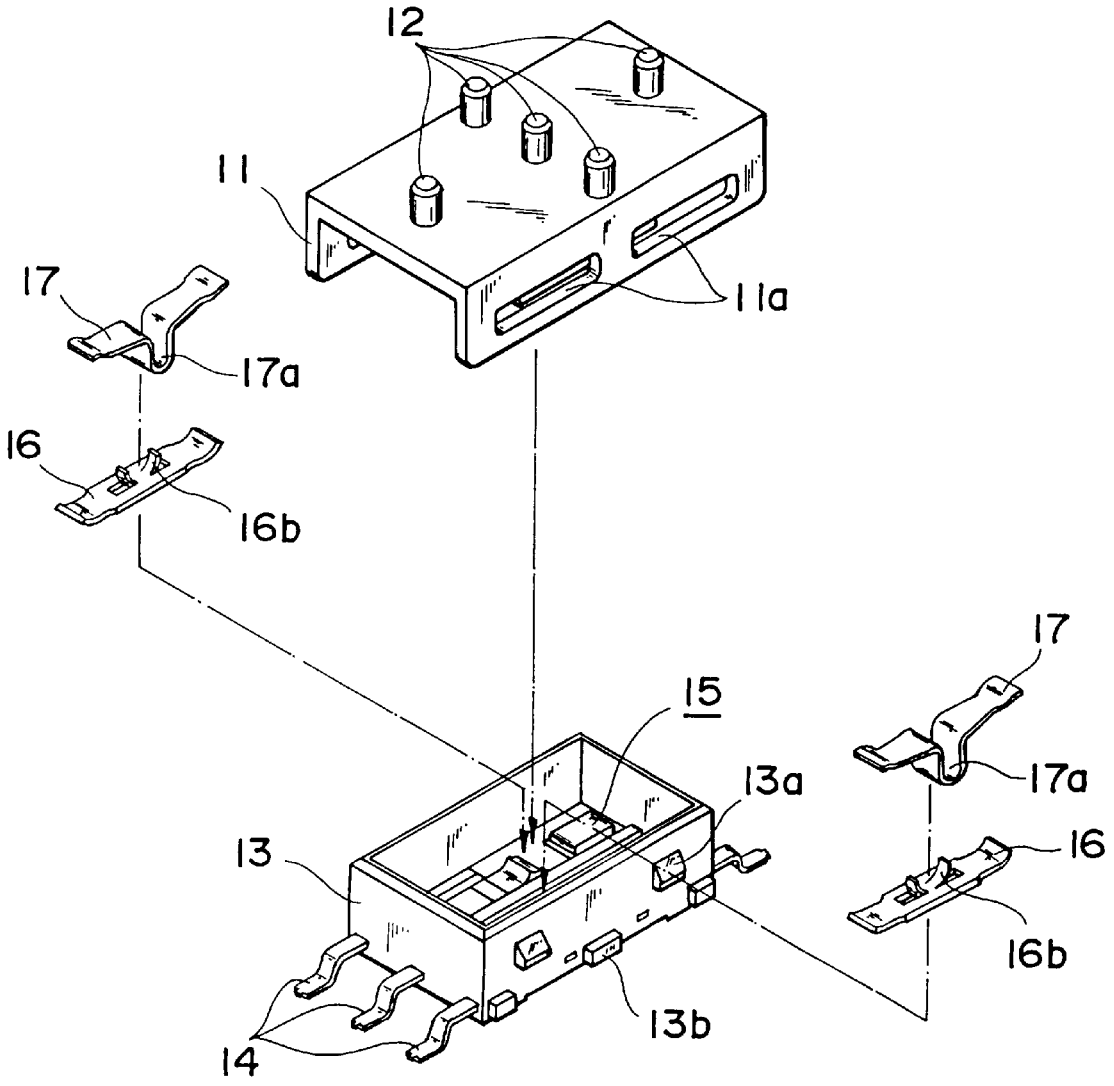
FIG. 4 is an exploded perspective view showing a switch unit in another example.

FIG. 4 illustrates a modified example of the switch unit, which slightly differs in the shapes of the driving projection 12 of the slider 11, the reed terminal 14 of the fixed contact 15, and the like from the switch unit shown in FIG. 3.

Figure 6A:
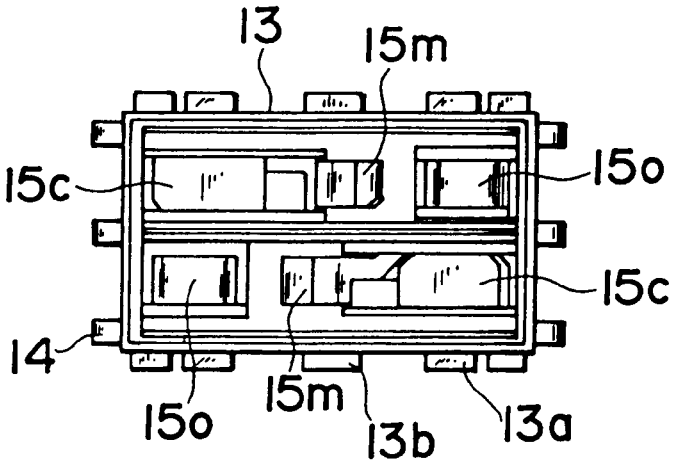
FIGS. 6*a*, 6*b*, and 6*c* are plan view, a front view, and a side view showing a terminal base.
Figure 6B:
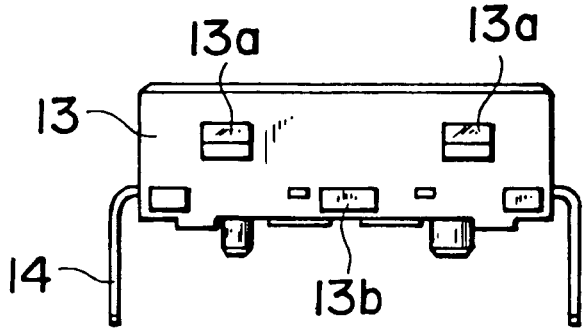
Figure 6C:
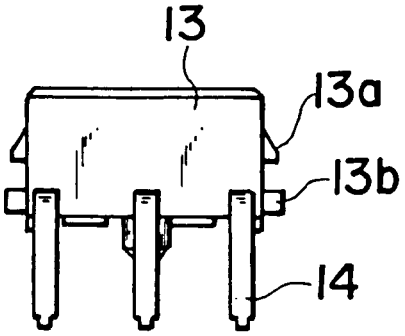

FIGS. 6*a*, 6*b*, and 6*c* are a plan view, a front view, and a side view showing the terminal base 13. The normally open contacts 15*o*, the normally closed contacts 15*c*, and the common contacts 15*m* which are the fixed contacts 15 provided in the terminal base 13 are arranged as shown in the drawings.

Figure 7A:
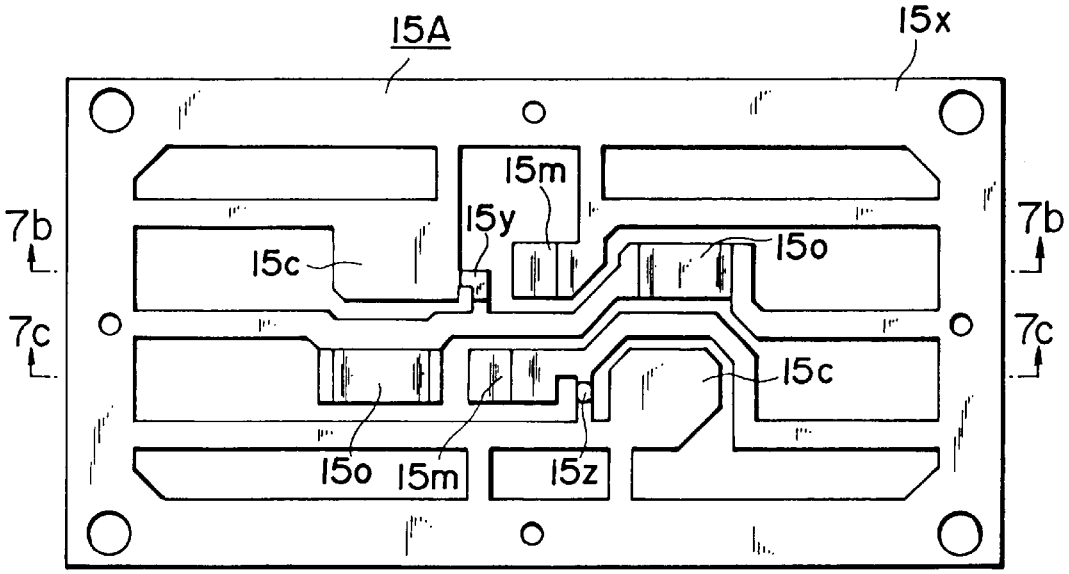
FIG. 7*a* is a plan view showing a plate punched out by a press before cutting which forms the basis of fixed contacts.
Figure 7B:
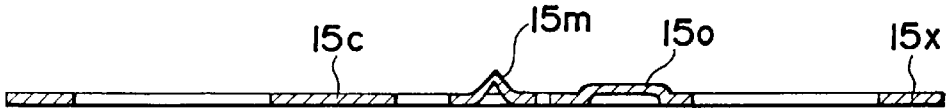
FIG. 7*b* is a cross-sectional view taken along a line 7*b*–7*b* shown in FIG. 7*a*.
Figure 7C:
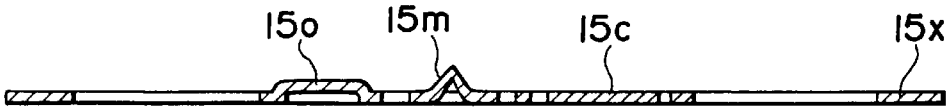
FIG. 7*c* is a cross-sectional view taken along a line 7*c*–7*c* shown in FIG. 7*a*.
Figure 8A:
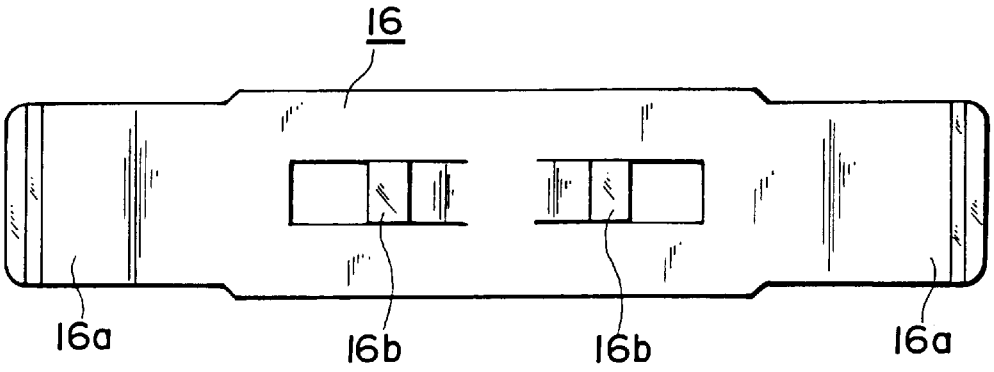
FIG. 8*a* and FIG. 8*b* are a plan view and a front view showing a movable contact.
Figure 8B:
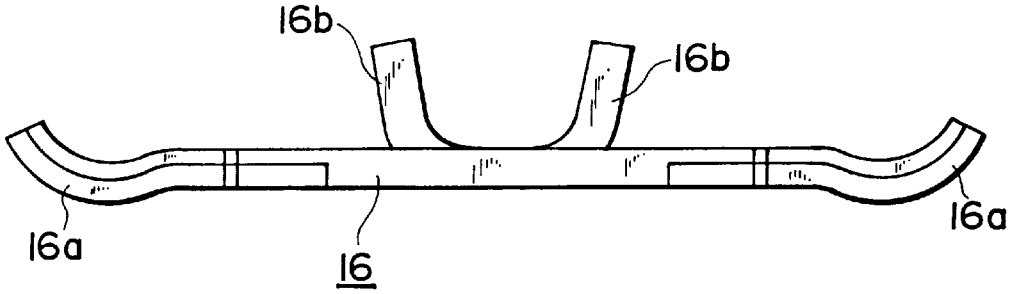

FIG. 7*a* is a plan view showing a plate 15A punched out by a press before cutting which forms the basis of the fixed contacts 15, and FIGS. 7*b* and 7*c* are cross-sectional views respectively taken along a line 7*b*–7*b* and a line 7*c*–7*c* shown in FIG. 7*a*. Such a plate punched out by a press is molded out of resin upon being held in a mold, and a frame 15*x* and other connecting portions 15*y* and 15*z* of the plate are cut away. As a result, the terminal base 13 having the above-mentioned arrangement of the fixed contacts can be fabricated. The common contact 15*m* projects upward as shown, and the movable contact member 16 is put thereon. FIGS. 8*a* and 8*b* are a plan view and a front view showing the movable contact member 16. A part obtained by pressing a metal plate is used for the movable contact member 16, and the U-shaped engaging members 16*b* are formed by being cut and raised.

Figure 9:
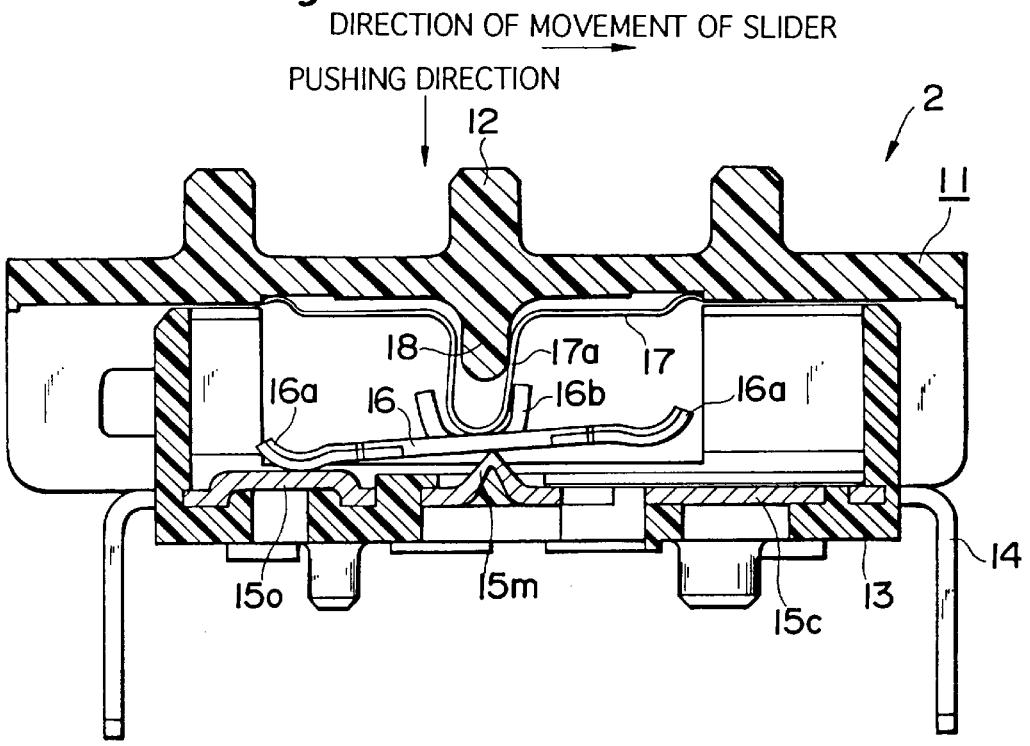
FIG. 9 and FIG. 10 are diagrams for explaining a contact separating operation of the switch unit.
Figure 10:
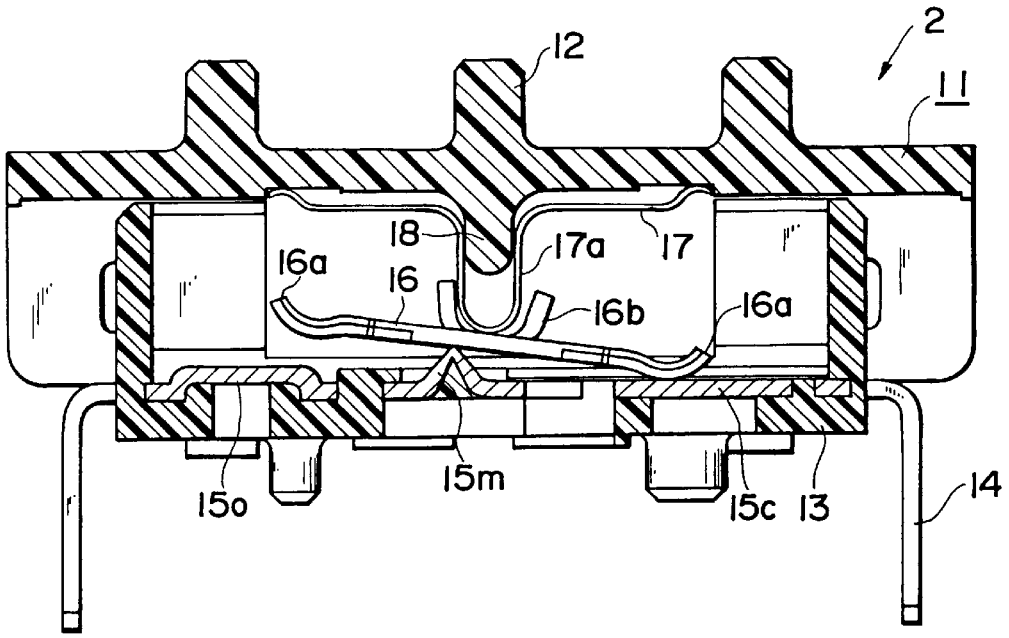

FIGS. 9 and 10 are diagrams for explaining a switching operation of the switch unit 2 constructed as described above (a state immediately before the contacts are separated from each other and a neutral state, respectively), which illustrate only one of the two rows of contacts.

When the normally open contact 15*o* is switched from its on state to its off state, the operating knob 4 is used, to move the slider 11 rightward. The substantially U-shaped portion 17*a* of the spring 17 pushes the right one of the U-shaped engaging members 16*b* of the movable contact member 16. The movable contact member 16 is inclined downward toward the left because the left contact 16*a* is in contact with the normally open contact 15*o* and the center thereof is put on the projecting common contact 15*m*. The slider 11 is moved rightward, while the spring 17 is slowly moved or almost stands still because a lower end of the U-shaped portion 17*a* of the spring 17 is forced to ascend a rightward slope. Therefore, the U-shaped portion 17*a* of the spring 17 is distorted, as shown in FIG. 9. This is the state immediately before the movable contact 16*a* is separated from the normally open contact 15*o*. A force for the spring 17 to push the movable contact member 16 is gradually increased.

When the lower end of the U-shaped portion 17*a* of the spring 17 gets beyond the common contact 15*m*, the movable contact member 16 is rapidly reversed, to enter the neutral state as shown in FIG. 10. The left movable contact 16*a* of the movable contact member 16 is separated from the normally open contact 15*o* at high speed and to a far position. Accordingly, an arc is hardly generated. The deformation of the U-shaped portion 17*a* of the spring 17 is canceled. The force for the spring 17 to push the movable contact member 16 is weaker, as compared with that before the movable contact member 16 is reversed. Before and after the movable contact member 16 is reversed, the movable contacts 16*a* slightly slide on the fixed contacts 15*o* and 15*c*.

Such an operation makes it possible to increase the speed at which the contacts are separated from each other without depending on the speed at which the slider 11 is operated. Consequently, the arc resistance is improved, and the deformation of resin due to heat generation and the abrasion of the contacts are decreased. Further, high reliability and durability are obtained by maintaining the wiping effect of the slide type seesaw system, the effect of preventing degradation of insulation, and the like as they are as a large-current on/off switch. Further, a low-cost material having low heat resistance and low arc resistance can be used for the slider 11 and the contacts.

Figure 11:
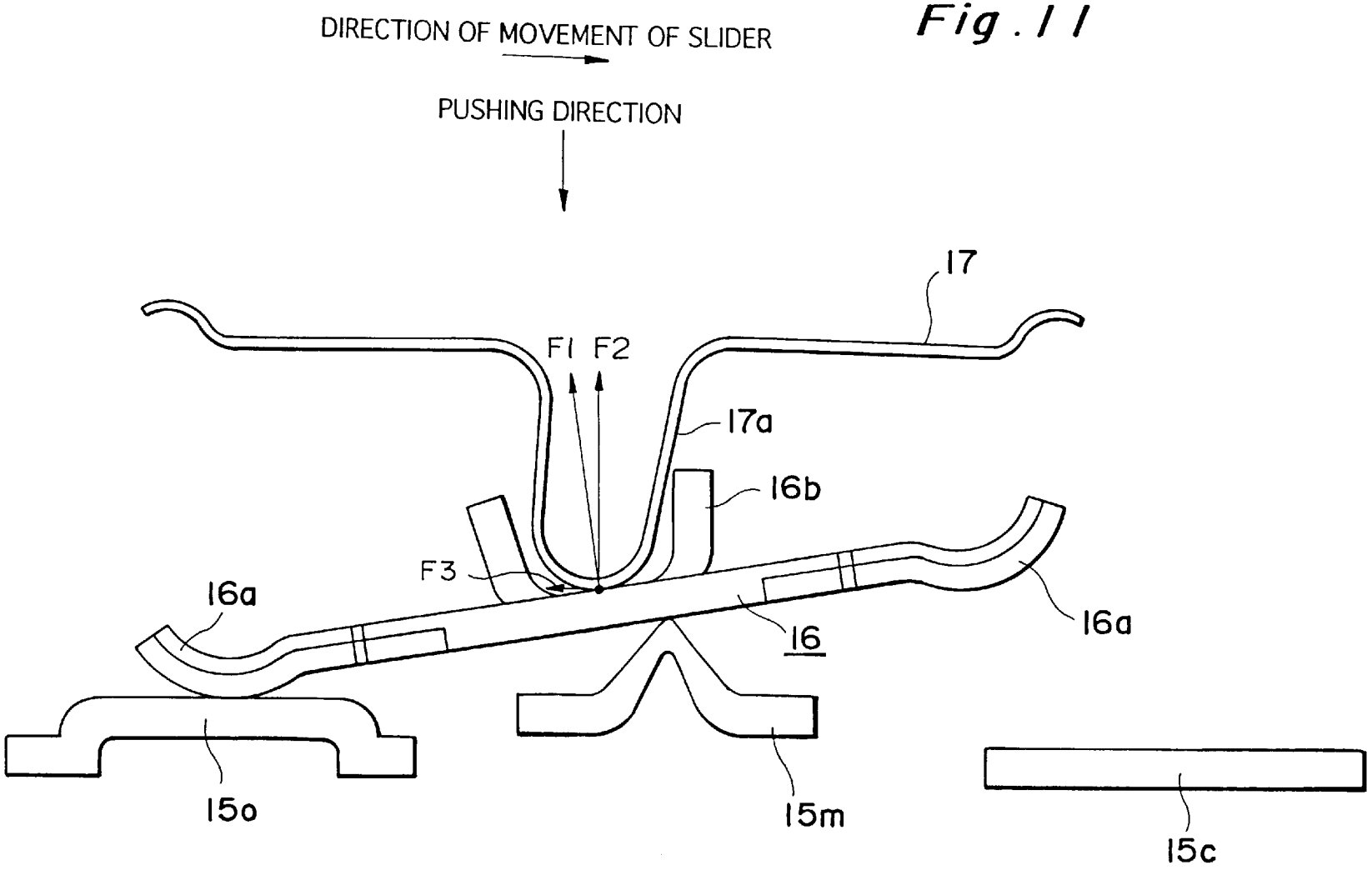
FIG. 11 and FIG. 12 are diagrams for explaining the details of the contact separating operation.
Figure 12:
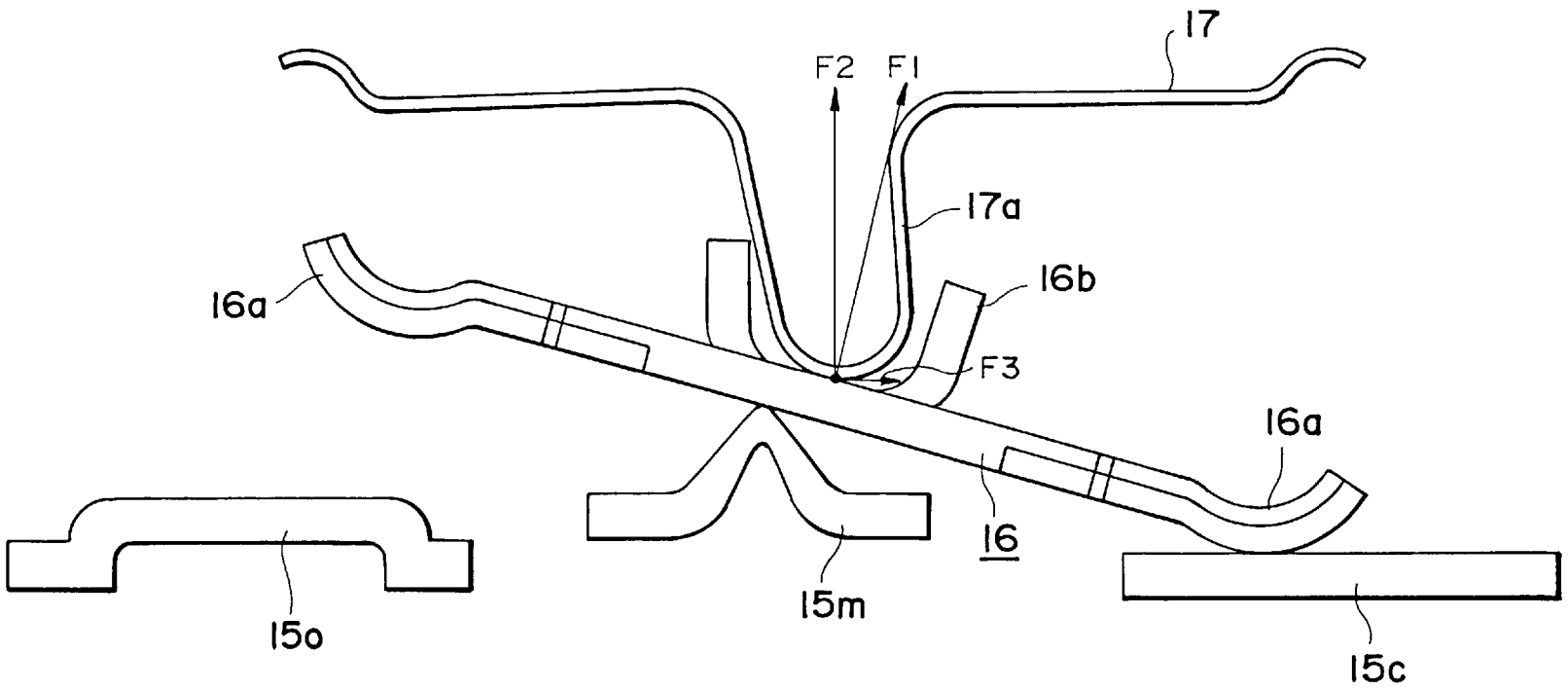

The detailed arrangement and the function of the switch for obtaining the above-mentioned contact separating operation will be described with reference to FIGS. 11 and 12. FIG. 11 illustrates a state immediately before the contacts are separated from each other, and FIG. 12 illustrates a state immediately after the contacts are separated from each other. As shown in FIGS. 11 and 12, the movable contact member 16 is inclined downward in the opposite direction to the direction in which the slider 11 (the operating member) is moved before the contacts are separated from each other, while being inclined downward in the direction in which the slider 11 is moved by the rotation of the movable contact 16 immediately after or simultaneously with the separation of the contacts, and the U-shaped portion 17*a* of the spring 17 is deformed depending on a component force of a pushing load in the direction in which the slider 11 is moved. In FIGS. 11 and 12, F1 indicates a force for the spring to push the fixed contact, F2 indicate a component force in the pushing direction, and F3 indicates a component force in the direction in which the operating member is moved.

The load in the pushing direction is gradually increased before the contacts are separated from each other, while being reduced immediately before or simultaneously with the separation.

Figure 13A:
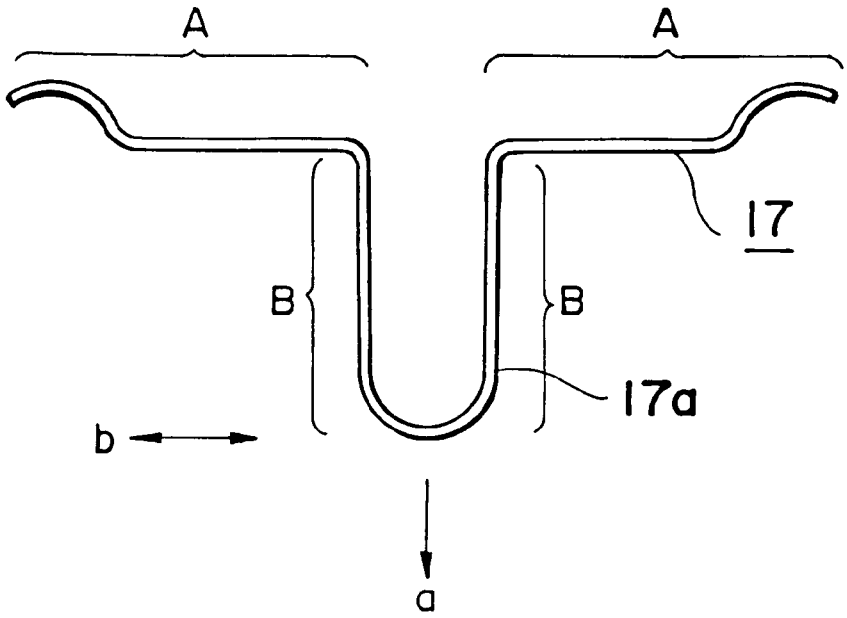
FIG. 13*a* is a diagram for explaining the function of a spring.

FIG. 13*a* is a diagram for explaining the function of the spring 17. The spring 17 comprises a portion A which can be deformed in the pushing direction and a portion B which can be deformed in the direction in which the slider is moved. a indicates the pushing direction, and b indicates the direction in which the slider is moved.

Figure 13B:
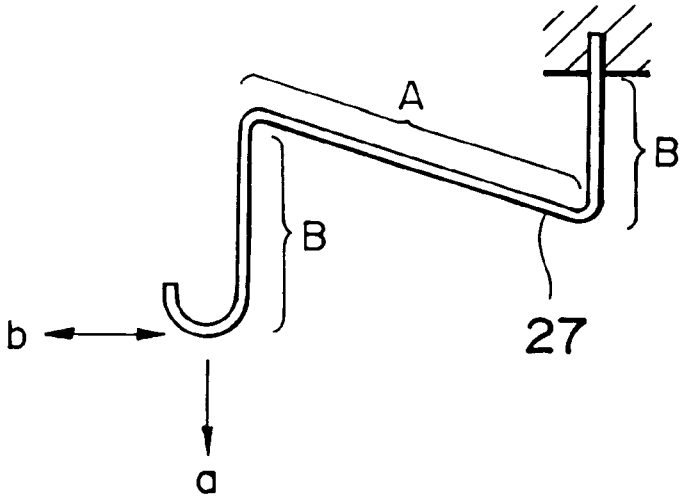
FIG. 13*b* is a diagram for explaining the function of a spring in another example.

FIG. 13*b* illustrates a spring 27 in another example. The spring 27 is constituted by a first portion fixed at its upper end and extending vertically downward (a portion B to be deformed in the direction in which the slider is moved), a second portion extending obliquely upward from a lower end of the first portion (a portion A to be deformed in the pushing direction), and a third portion extending vertically downward from an end of the second portion (a portion B to be deformed in the direction in which the slider is moved).

Figure 14:
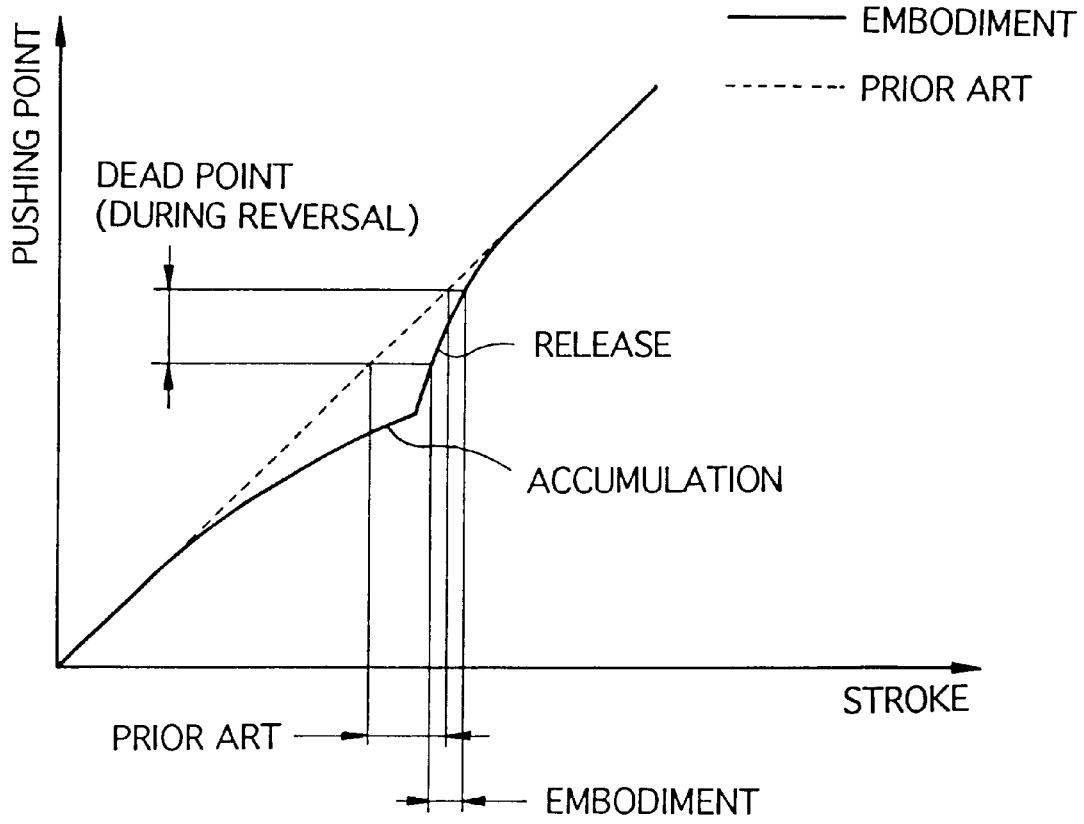
FIG. 14 is a graph showing the relationship between a stroke and the position of a pushing point.

FIG. 14 illustrates the relationship between a stroke and the position of a pushing point (a point at which the spring and the movable contact member are in contact with each other). A solid line indicates the relationship in the present embodiment, and a broken line indicates the relationship in the conventional example (prior art). In the present embodiment, an "accumulation" is positively roduced at the pushing point immediately before the reversal, and the "accumulation" is released simultaneously with the reversal, to increase the speed at which the contacts are separated. Consequently, the speed at which the contacts are separated from each other is increased. A dead point at the time of the reversal is determined by the position of the pushing point.

Figure 15C:
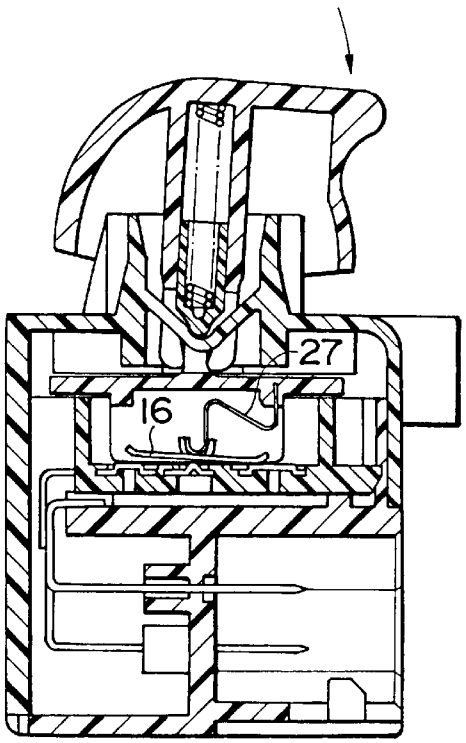
FIGS. 15*a*, 15*b*, and 15*c* are cross-sectional views respectively showing a state where contacts are on, a state immediately before the contacts are separated from each other, and a state where the contacts are separated from each other in a switch according to another embodiment.
Figure 15B:
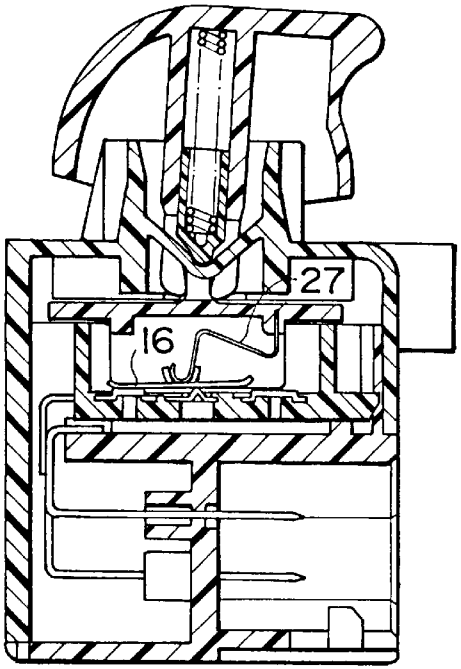
Figure 15A:
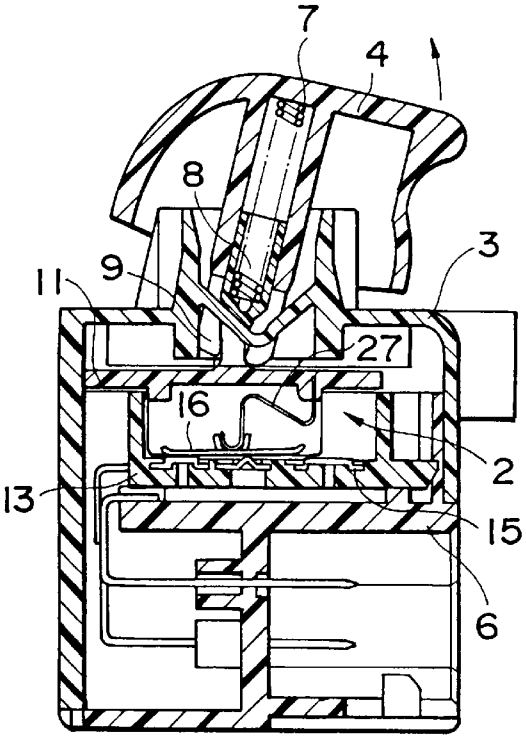
Figure 16:
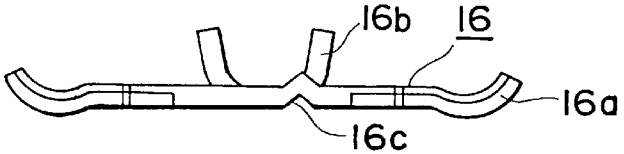
FIG. 16 is a side view showing another example of a movable contact member.
Figure 17:
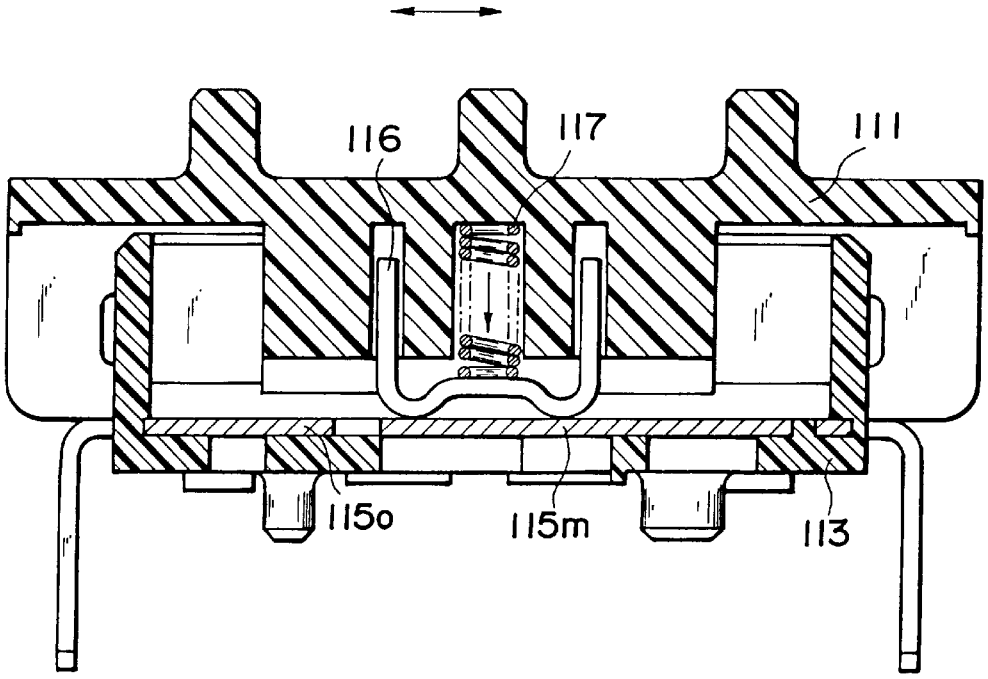
Fig. 17 PRIOR ART
FIG. 17 is a cross-sectional view showing a conventional switch.
Figure 18:
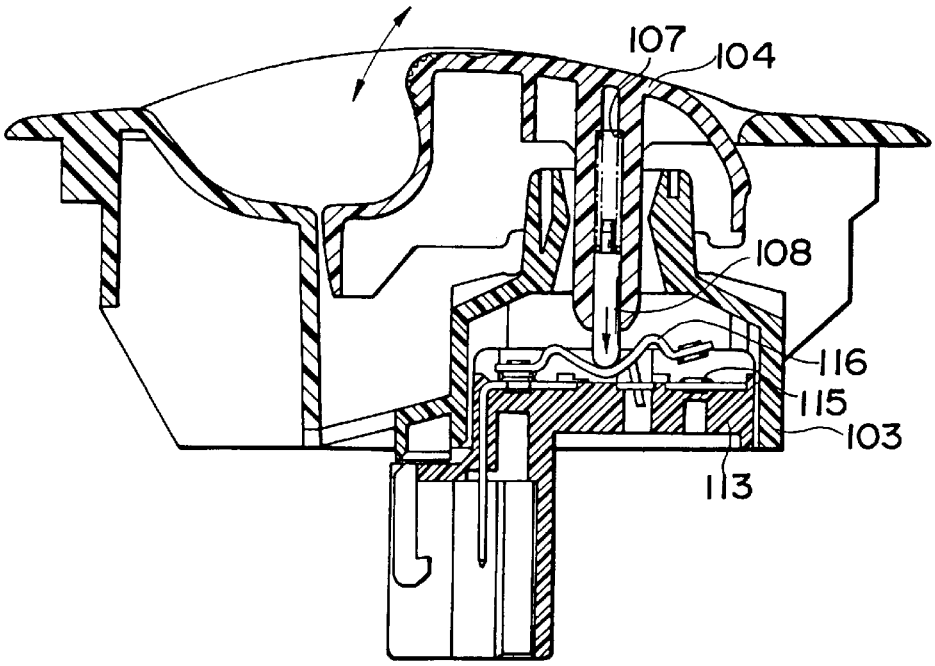
Fig. 18 PRIOR ART
FIG. 18 is a cross-sectional view showing another conventional switch.

FIGS. 15*a*, 15*b* and 15*c* are diagrams showing a switch according to another embodiment, which respectively illustrate a state where contacts are on, a state immediately before the contacts are separated from each other, and a state where the contacts are separated from each other in a case where the spring 27 shown in FIG. 13*b* is used. In the drawings, the same numbers as the foregoing numbers are assigned to the same members. An upper end of the spring 27 is coupled to the slider 11, and a lower end thereof is engaged with an engaging member of a movable contact 16. As shown in FIG. 16, a groove by which a common contact 15*m* is caught or engaged is formed on the lower surface of the movable contact 16. The catching or engaging shape may be a shape having a projection or a slope in addition to the groove, and is provided on the right side of the center of the movable contact member 16. The position of a point at which the spring 27 pushes the movable contact member 16 is not changed by the catching shape until the slider 11 is moved by a predetermined amount. When the slider 11 is further moved, the catching shape separates from the common contact 15*m*, so that the movable contact member 16 is reversed upon being rapidly displaced in the direction in which the slider 11 is moved. Specifically, in the present embodiment, the above-mentioned "accumulation" is large.

In the present embodiment, a current flows between the movable contact and a normally open contact. When the movable contact is separated from the normally open contact, an arc is liable to generate. The groove 16*c* may be provided only on the right side of the center of the movable contact member 16 because it is for preventing the generation of the above arc. It goes without saying that the catching shape such as the groove may be provided on both sides of the center of the movable contact member 16.

The present invention is not limited to the arrangements in the above-mentioned embodiments, and various modifications are possible. Although in the above-mentioned embodiment, the arrangement comprising as fixed contacts the normally open contact and the normally closed contact which are provided on the left and right sides of the common contact, for example, is illustrated, an arrangement comprising only a contact a comprising a contact and a common contact (without a normally closed fixed contact) may be used. Although an example in which common contact projects upward is illustrated, the common contact need not necessarily project upward depending on the shape of the movable contact member 16. Further, although an example in which the slider 11 serving as an operating member performs a sliding operation, it may perform a rotating operation, in which case the present invention is similarly applicable. As a spring for biasing a movable contact under pressure, not a spring alone but a combination of a spring and a pushing member may be used.

Although the present invention has been described and illustrated in detail, it is clearly understood that the same is by way of illustration and example only and is not to be taken by way of limitation, the spirit and scope of the present invention being limited only by the terms of the appended claims.

what is claimed is:

1. A switch comprising:

a terminal base including a first fixed contact, a second fixed contact, a movable contact member having a movable contact in its part and swingably supported at the position of the first fixed contact, a resilient member for biasing the movable contact member such that the movable contact is brought into contact with or separated from the second fixed contact; and an operating member connected to said terminal base for supporting the resilient member, wherein said first fixed contact is formed in a projecting shape, and serves as a fulcrum of said movable contact member, said resilient member is deformable in a first direction in which said movable contact is brought into contact with said second fixed contact and in a second direction along the length of the movable contact member, said resilient member, having a base end and a free end, is fixed to said operating member at the base end, and is engaged with said movable contact member at the free end, and said resilient member is deformed in said second direction when said operating member is moved in the direction along the length of said movable contact member, and the movable contact member is moved along its length in this state, and swings so that said movable contact which is in contact with said second fixed contact is separated from the second faxed contact when the free end of the resilient member crosses over said fulcrum.

2. The switch according to claim 1, wherein said movable contact member is biased by the free end of said resilient member in the direction in which said movable contact is brought into contact with said second fixed contact due to the deformation in said first direction of the resilient member, a biasing force caused by the deformation in the first direction of said resilient member being gradually increased as said operating member is moved, while being decreased when the free end of the resilient member crosses over said fulcrum.

3. The switch according to claim 1, wherein an engaging portion is formed on the lower surface of said movable contact member, and said engaging portion being engaged with said first fixed contact when the movable contact member is moved, while being disengaged therefrom by further movement of said operating member, so that the movement and the swing of the movable contact member are accelerated.

4. A switch comprising:

a terminal base including a movable contact member having a moveable contact in its part and swingably supported by a fulcrum, a resilient member having a base end and a pushing end, said resilient member being brought into contact with said movable contact member at the pushing end and is deformable in a first direction in which the resilient member pushes the movable contact member and in a second direction along the length of the movable contact member; and an operating member connected to said terminal base for supporting said resilient member at the base end and moved by an external force, wherein the deformation of said resilient member in said second direction becomes large as the operating member is moved in a state where said movable contact of the movable contact member is brought into contact with a fixed contact, and the movable contact member swings so that the movable contact is separated from said fixed contact when said pushing end crosses over said fulcrum by further movement of said operating member.

5. The switch according to claim 4, wherein the pushing end of said resilient member is engaged with said movable contact member, and the movable contact member is moved along its length as the operating member is moved.

6. The switch according to claim 4, wherein the pushing end of said resilient member is movable along said movable contact member.

7. The switch according to claim 6, wherein said fulcrum is provided in said movable contact member.

8. The switch according to claim 4, said fulcrum is formed of a second fixed contact.

9. The switch according to claim 4, wherein said resilient member comprises a spring, or a spring and a pushing member.

10. The switch according to claim 4, wherein said operating member is slid.

11. The switch according to claim 4, wherein said resilient member is gradually deformed in said first direction as said operating member is moved, so that a pushing force of the resilient member is gradually increased.

12. The switch according to claim 11, wherein said pushing force is decreased when the pushing end of said resilient member goes beyond said fulcrum.

13. The switch according to claim 4, wherein an engaging portion is formed in said movable contact member, and the pushing end of said resilient member or the fulcrum is engaged with said engaging portion as said operating member is moved, while being disengaged therefrom by further movement of the operating member, so that the swing of the movable contact member is accelerated.

14. The switch according to claim 4, wherein said operating member is rotated.

* * * * *